US011501673B1

(12) United States Patent
Blizzard et al.

(10) Patent No.: US 11,501,673 B1
(45) Date of Patent: Nov. 15, 2022

(54) REMOVABLE CASING FOR ROBOTIC SYSTEMS

(71) Applicant: CreateMe Technologies LLC, New York, NY (US)

(72) Inventors: David Blizzard, San Francisco, CA (US); Khamvong Thammasouk, San Jose, CA (US); Jinhwa Jung, San Jose, CA (US)

(73) Assignee: CreateMe Technologies LLC, New York, NY (US)

( * ) Notice: Subject to any disclaimer, the term of this patent is extended or adjusted under 35 U.S.C. 154(b) by 0 days.

(21) Appl. No.: 17/730,995

(22) Filed: Apr. 27, 2022

Related U.S. Application Data

(63) Continuation of application No. 17/560,037, filed on Dec. 22, 2021, now Pat. No. 11,398,170.

(51) Int. Cl.

| | |
|---|---|
| ***G09F 21/04*** | (2006.01) |
| ***G09F 9/30*** | (2006.01) |
| ***G09F 13/00*** | (2006.01) |
| ***G09F 13/22*** | (2006.01) |

(52) U.S. Cl.
CPC ..... *G09F 21/048* (2013.01); *G09F 9/30* (2013.01); *G09F 13/005* (2013.01); *G09F 13/22* (2013.01); *G09F 2013/227* (2013.01)

(58) Field of Classification Search
CPC ..... G09F 21/048; G09F 13/005; G09F 13/22; G09F 2013/227; G09F 9/30; B25J 19/0075; B25J 19/0083
See application file for complete search history.

(56) References Cited

U.S. PATENT DOCUMENTS

| | | | | |
|---|---|---|---|---|
| 5,845,958 | A * | 12/1998 | Rudys | B60J 11/06 296/136.08 |
| 6,099,067 | A * | 8/2000 | Butterworth | B60J 11/00 135/88.05 |
| 8,585,854 | B2 * | 11/2013 | Butterworth, III | B05B 15/50 901/14 |
| 11,254,154 | B1 * | 2/2022 | Thammasouk | B65G 1/1375 |
| 2004/0187989 | A1 * | 9/2004 | D'Andreta | B25J 19/0075 150/154 |
| 2004/0258877 | A1 * | 12/2004 | D'Andreta | B05B 15/50 428/99 |
| 2010/0226117 | A1 * | 9/2010 | Krans | G09F 13/22 28/100 |
| 2011/0298604 | A1 * | 12/2011 | Peerali | E01F 15/141 40/606.03 |
| 2013/0011234 | A1 * | 1/2013 | Pretlove | B25J 5/005 701/2 |

* cited by examiner

*Primary Examiner* — Gary C Hoge
(74) *Attorney, Agent, or Firm* — Patterson + Sheridan, LLP

(57) ABSTRACT

Embodiments herein describe systems and methods for visually identifying a wheeled robot and associating the wheeled robot with a company or brand. Some embodiments provide a cover, casing, or skin that may be removably attached to the wheeled robot. The casing may feature a pattern, logo, or visuals that are associated with the company. The casing may further conform to features of the movable robot such that the casing does not impede the robot from moving and performing functions, such as transporting objects. The casing may further have a flap that removably attaches to the casing to allow access to the wheeled robot.

18 Claims, 13 Drawing Sheets

REMOVABLE CASING FOR ROBOTIC SYSTEMS

CROSS-REFERENCE TO RELATED APPLICATION

This application is a continuation of U.S. patent application Ser. No. 17/560,037, filed Dec. 22, 2021, which is herein incorporated by reference in its entirety.

BACKGROUND

Systems and methods for moving objects may use a wheeled robot, sometimes referred to as a rover. For example, a warehouse operation may use the wheeled robot to move goods. The wheeled robot may operate independently, or may be part of an environment having multiple wheeled robots. Some environments may use multiple wheeled robots of the same type or model, which may present challenges when attempting to differentiate the wheeled robots from another.

Despite these challenges, the wheeled robots may need to identify each other. Operators, maintainers, and the like may also need to identify each wheeled robot. Further, manufacturers and designers of the objects to be moved by the wheeled robot may desire to associate the wheeled robot with their company or brand. For example, the warehouse may contain objects from several manufacturers and one of the manufacturers may have a dedicated wheeled robot to move their goods. The one manufacturer may desire for the dedicated wheeled robot to stand out from the other wheeled robots so the dedicated wheeled robot is associated with the manufacturer.

Some techniques for identifying the wheeled robots may use markings or labels. However, markings and labels may not be easily visible and manufactures may desire a more elegant approach. Other techniques may paint the wheeled robots, but this approach may be problematic if there is a need to associate the wheeled robot with a different company or if identifying visuals of a company change.

Accordingly, there is a need for a system and method for associating a wheeled robot with a company or brand, where the association may be changed to a different manufacturer.

It should be noted that the information included in the Background section herein is simply meant to provide a reference for the discussion of certain embodiments in the Detailed Description. None of the information included in this Background should be considered as an admission of prior art.

SUMMARY

Certain embodiments provide a cover for use with a wheeled robot. The cover includes a deformable body substantially sized and shaped to receive the wheeled robot and conform thereto. The deformable body includes a skirt defining an interior surface to engage with a corresponding exterior side surface of the wheeled robot. The cover also includes a top flap coupled to the deformable body. The top flap is coupled to a first portion of the skirt and the top flap is configured to removably attach to at least a second portion of the skirt to allow access to the wheeled robot. The cover is configured to removably conform to the wheeled robot.

Other aspects provide a removable skin for a wheeled robot. The removable skin includes a body. The body the body defines a cavity substantially conforming to a shape of the wheeled robot and configured to accept the wheeled robot. The body further defines an opening configured to accommodate a wheel of the wheeled robot. The removable skin further includes a top fold configured to cover the cavity when the removable skin is disposed on the wheeled robot. The removable skin is configured to be reusable.

Other aspects provide a method of installing a removable skin on a wheeled robot. The method includes placing the wheeled robot in a cavity formed by the removable skin. A wheel of the wheeled robot protrudes through an opening of the removable skin. The method further includes folding a top fold of the removable skin over a top of the wheeled robot such that the removable skin encases the wheeled robot. The method further includes coupling a first fastener element of the top fold to a second fastener element of the removable skin. The method further includes transporting a garment with the wheeled robot after the removable skin is installed.

BRIEF DESCRIPTION OF THE DRAWINGS

So that the manner in which the above-recited aspects are attained and can be understood in detail, a more particular description of embodiments described herein, briefly summarized above, may be had by reference to the appended drawings.

It is to be noted, however, that the appended drawings illustrate typical embodiments and are therefore not to be considered limiting; other equally effective embodiments are contemplated.

DETAILED DESCRIPTION

Embodiments herein describe systems and methods for visually identifying a wheeled robot and associating the wheeled robot with a company or brand (collectively referred to as the company). Some embodiments provide a cover, casing, or skin (collectively referred to as the casing) that may be removably attached to the wheeled robot. The casing may feature a pattern, logo, or visuals that are associated with the company. The casing may further conform to features of the movable robot such that the casing does not impede the robot from moving and performing functions, such as transporting objects. The casing may further have a flap that removably attaches to the casing to allow access to the wheeled robot.

Examples of Covers for Use with a Wheeled Robot

Figure 1A:
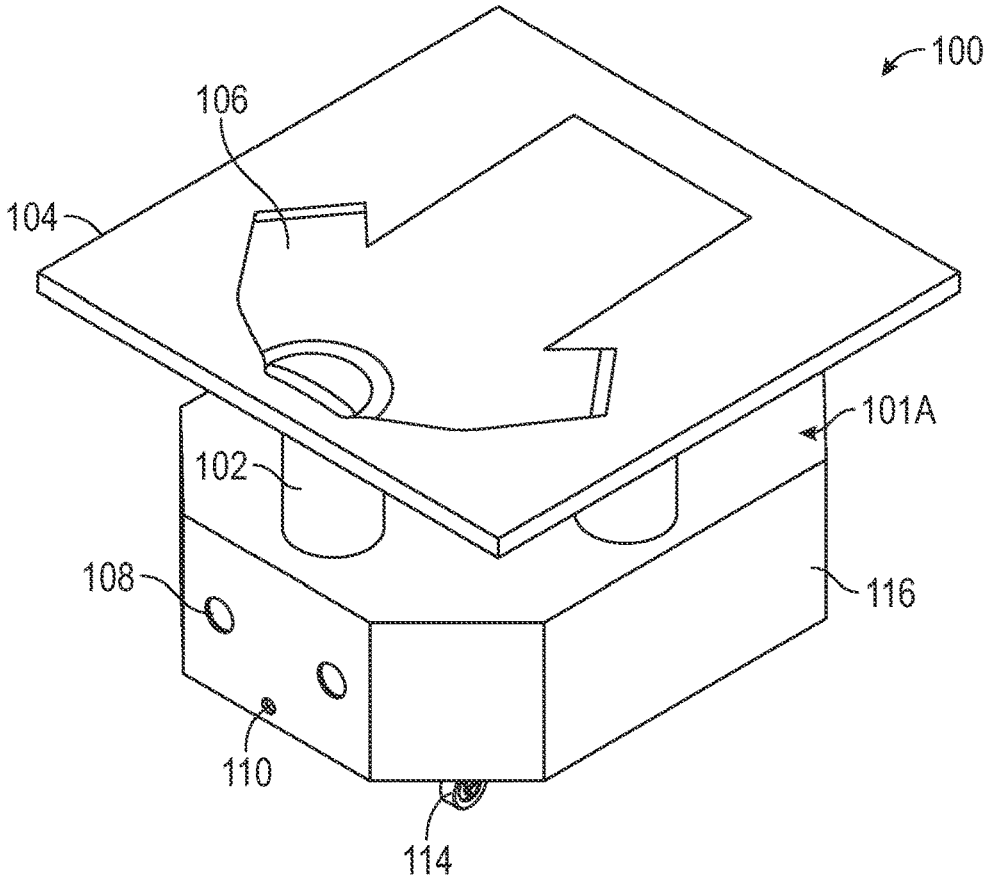
FIGS. 1A and 1B depict top isometric views of a wheeled robot and a cover, according to some embodiments.
Figure 1B:
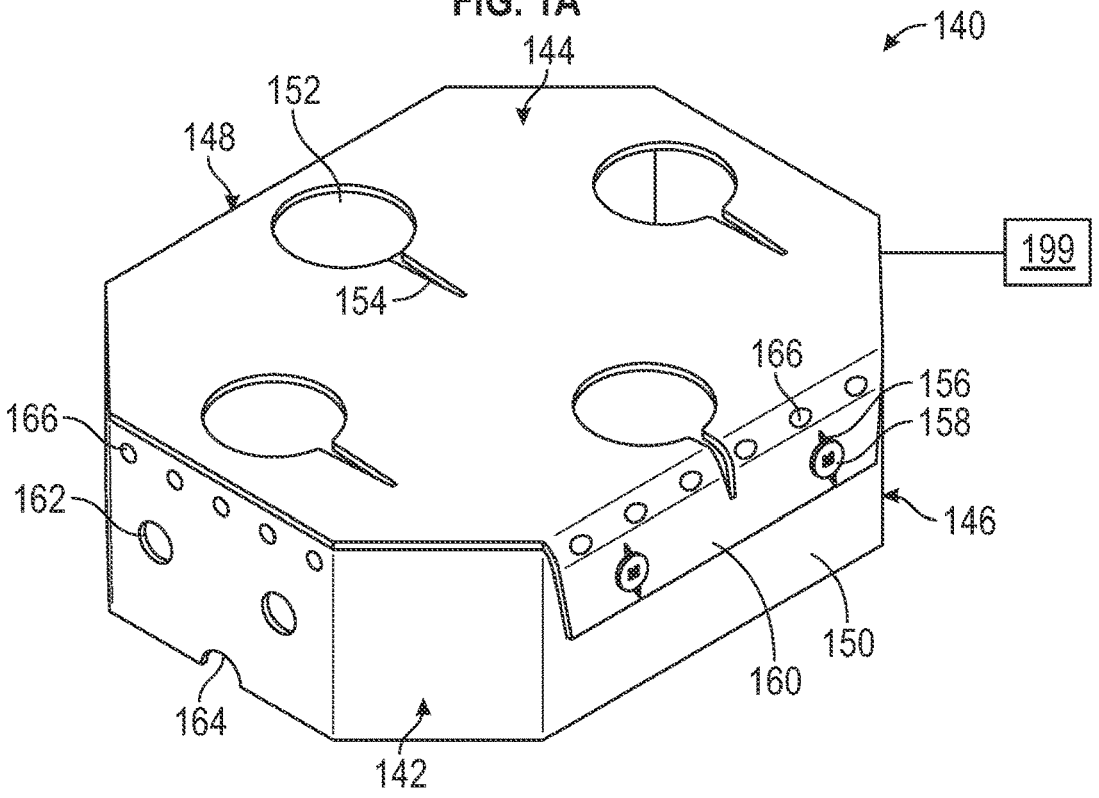

FIGS. 1A and 1B depict top isometric views of a wheeled robot 100 and a cover, such as a removable casing 140, according to some embodiments. The removable casing 140 (referred to as the casing 140) is configured to removably conform to the wheeled robot 100 (referred to as the robot 100).

In particular, FIG. 1A shows the robot 100 without the casing 140. In the depicted embodiment, the robot 100 comprises a plurality of support members 102 that support a plate 104 or platen. The support members 102 protrude from a top 101A of the robot 100. The robot 100 may be used to transport a garment 106, which may rest on the plate 104, between different direct to garment digital processing stages. The robot 100 further includes at least one light 108 and a sensor 110. The at least one light 108 may be used to illuminate the surrounding environment to allow the sensor 110, which may be a camera or optical sensor, to visualize the surrounding environment. The at least one light 108 may also be used to indicate the robot's 100 presence to surrounding robots or people. U.S. patent application Ser. No. 17/364,694, filed Jun. 30, 2021 entitled "GARMENT PERSONALIZATION WITH AUTONOMOUS ROBOTS" describes embodiments of a robot, such as the robot 100, as described herein which is incorporated herein by reference in its entirety.

The robot 100 further comprises at least one motorized wheel 112 (FIG. 1C) to move the robot and a plurality of caster wheels 114 to balance the robot 100 and to help the motorized wheel 112 turn the robot 100. Although shown as solid, at least one wall 116 may be omitted from the robot 100 to form an opening such that components inside the robot 100 may be easily accessed for maintenance and repairs.

In some embodiments, the sensor 110 may be an ultrasonic sensor to measure distance to an obstacle. In some embodiments, the sensor 110 may be a contact sensor, a light detection and ranging (LIDAR) sensor, or a cliff sensor to help the robot 100 navigate an environment such as a warehouse.

FIG. 1B shows the casing 140 as it would be if installed on the robot 100 (FIG. 1A). The casing 140 comprises a deformable body 142 substantially sized and shaped to receive the robot 100 and conform thereto. The deformable body 142 may collapse on itself such that it may be folded or stowed for packaging or storage, and may further stretch to conform to the robot 100. The deformable body 142 comprises a skirt 146 defining an interior surface 149 (FIG. 1E) to engage with a corresponding exterior side surface 118 of the wheeled robot 100. The casing 140 further comprises a top flap 144 coupled to the deformable body 142. In the depicted embodiment, the top flap 144 is coupled to a first portion 148 of the skirt 146 and the top flap 144 removably attaches to at least a second portion 150 of the skirt 146 to allow access to the robot 100. Thus, the casing 140 having the top flap 144 may beneficially provide easy, quick access to robot 100 and its components for maintenance or repair.

The top flap 144 further defines a plurality of support member openings 152 and at least one buttonhole 156. Each support member opening 152 is sized and shaped to receive a respective support member 102 of the robot 100. The support member openings 152 comprise a slit 154 to accept the respective support members 102 when the top flap 144 folds over the top 101A of the robot 100. For example, the slits 154 may allow support member openings 152 to expand to compensate for a height of the support members 102. The slits 154 may extend out from the support member openings 152 in a radial direction. In the depicted embodiment, a fastening portion 160 of the top flap 144 defines the at least one buttonhole 156, which is sized and shaped to receive a respective button 158 of the second portion 150 of the skirt 146. The button 158 button removably attaches the top flap 144 to at least the second portion 150 of the skirt 146.

In the embodiment depicted in FIG. 1B, the deformable body 142 defines at least one light opening 162 to allow light from the respective light 108 of the robot 100 to pass through and a sensor opening 164 to allow the sensor 110 of the robot 100 to sense through the casing 140. The casing 140 further comprises a plurality of lights 166. In some embodiments, the lights 166 may be used to identify the robot 100. For example, the lights 166 may blink at a predefined color, frequency or pattern, specific way of pulsing (turning on and off), each uniquely identifying a different robot 100. In some embodiments, the lights 166 may be operable to signal the direction of a turn of the robot. In some embodiments, the lights 166 may have a decorative function in making the robots more attractive. Thus, the casing 140 may also provide easy, quick re-skinning of the robots with decorative features. In some embodiments, the lights 166 may emit light outside a visible spectrum but visible to specialized cameras (e.g., infrared, ultra-violet). In some embodiments, the lights 166 may be used to indicate the robot's 100 presence or intended motion to surrounding robots or people. For example, the lights 166 may function as a blinker to indicate a direction in which the robot 100 intends to turn.

Figure 7:
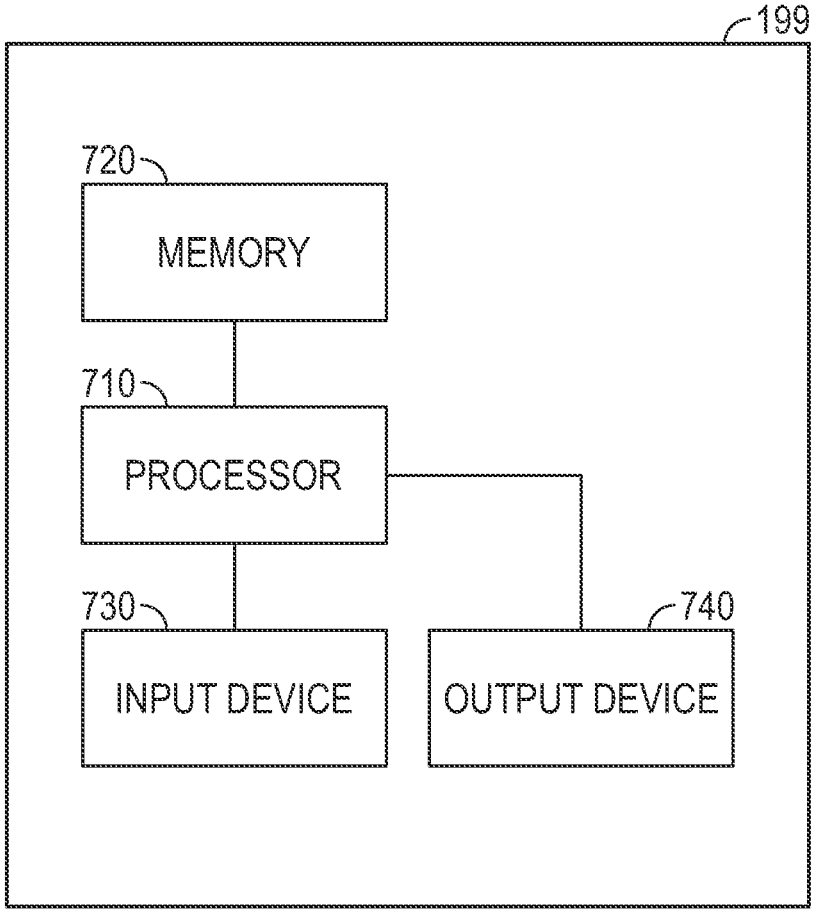
FIG. 7 is a block diagram of a control system for a cover for use with a wheeled robot, according to some embodiments.

The casing 140 may include a computer 199 to control components of the casing 140 such as discussed in relation to FIG. 7. For example, the computer 199 may control the blinking of the lights 166 at the predefined frequency or pattern. In some embodiments, the robot 100 comprises the computer 199 and the computer 199 interfaces with the casing 140. In some embodiments, the lights 166 are controlled by the robot 100. In some embodiments, the lights 166 are controlled by a central control system that may communicate with the robot 100 and/or control the robot's 100 movements, actions, and the lights 108.

In some embodiments, the lights 166 may be light emitting diodes (LEDs). In some embodiments, the lights 166 may emit white light. In some embodiments, the lights 166 may emit a colored light. In some embodiments, the color of the lights 166 may programmable, such as by the computer 199. In some embodiments, the lights 166 may be powered by a battery pack (not shown) of the casing 140. In some embodiments, the lights 166 may be powered by the robot 100.

Figure 2A:
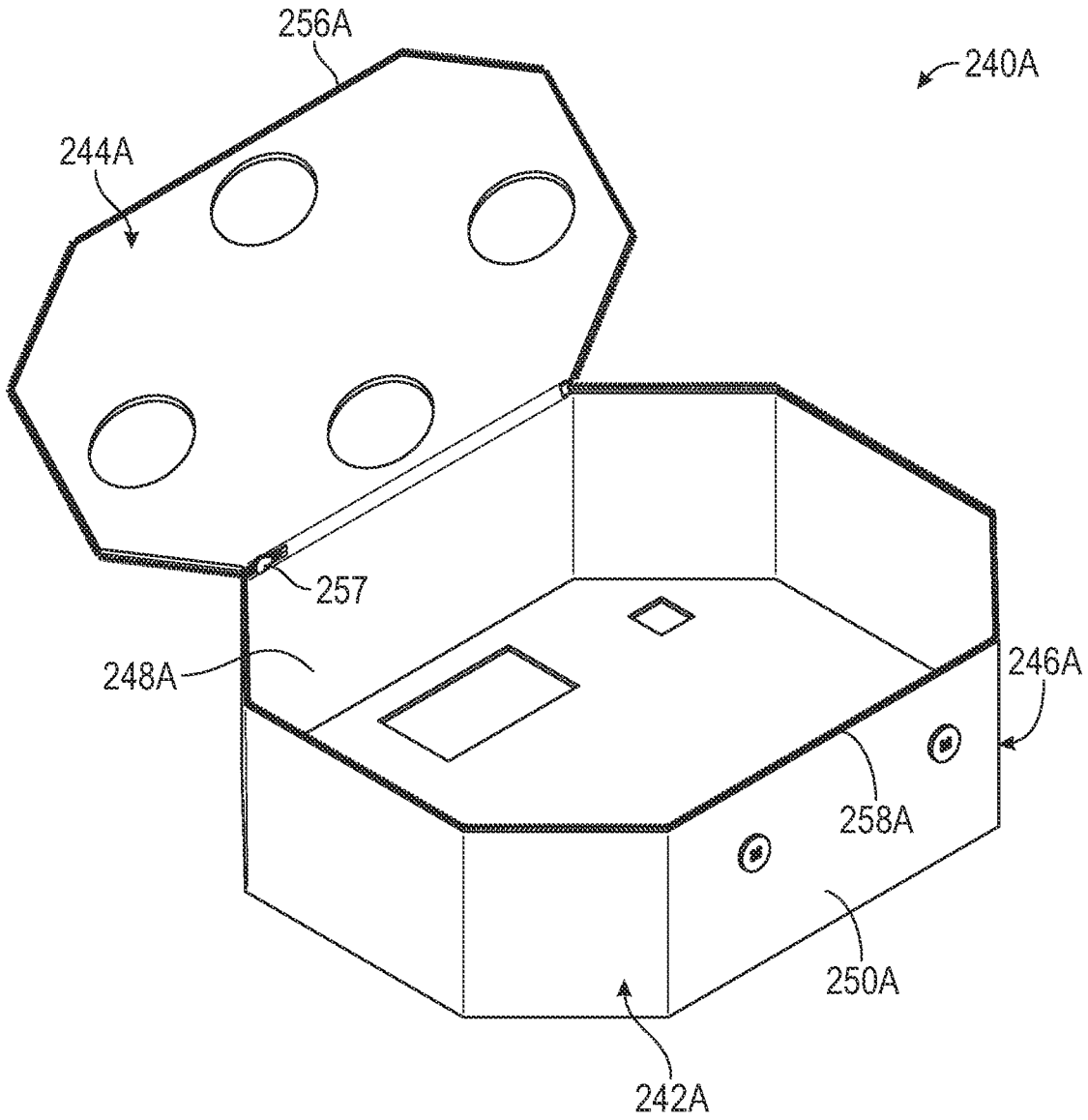
FIGS. 2A-2C depict different fastening systems of a cover, according to some embodiments.
Figure 2B:
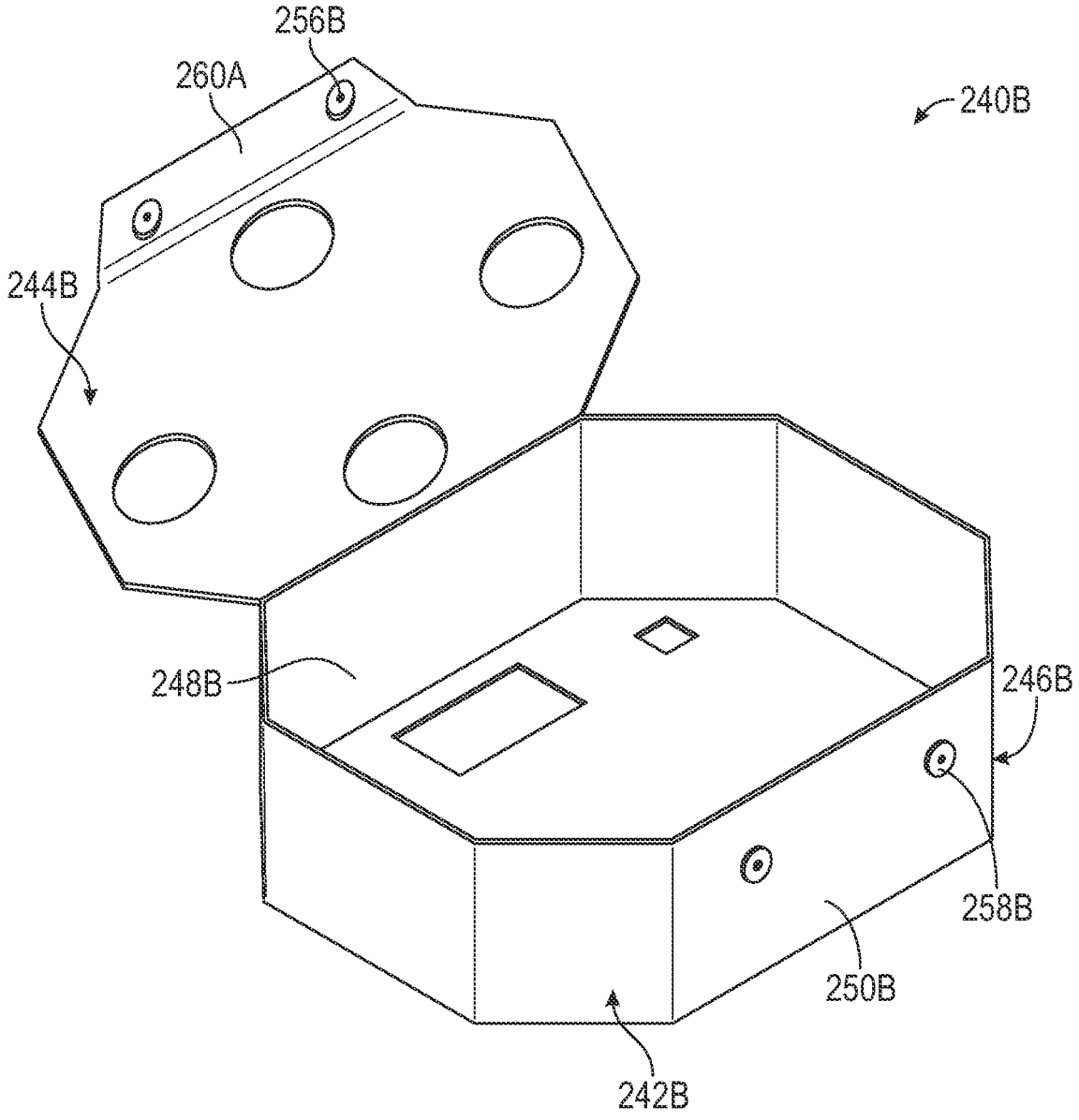
Figure 2C:
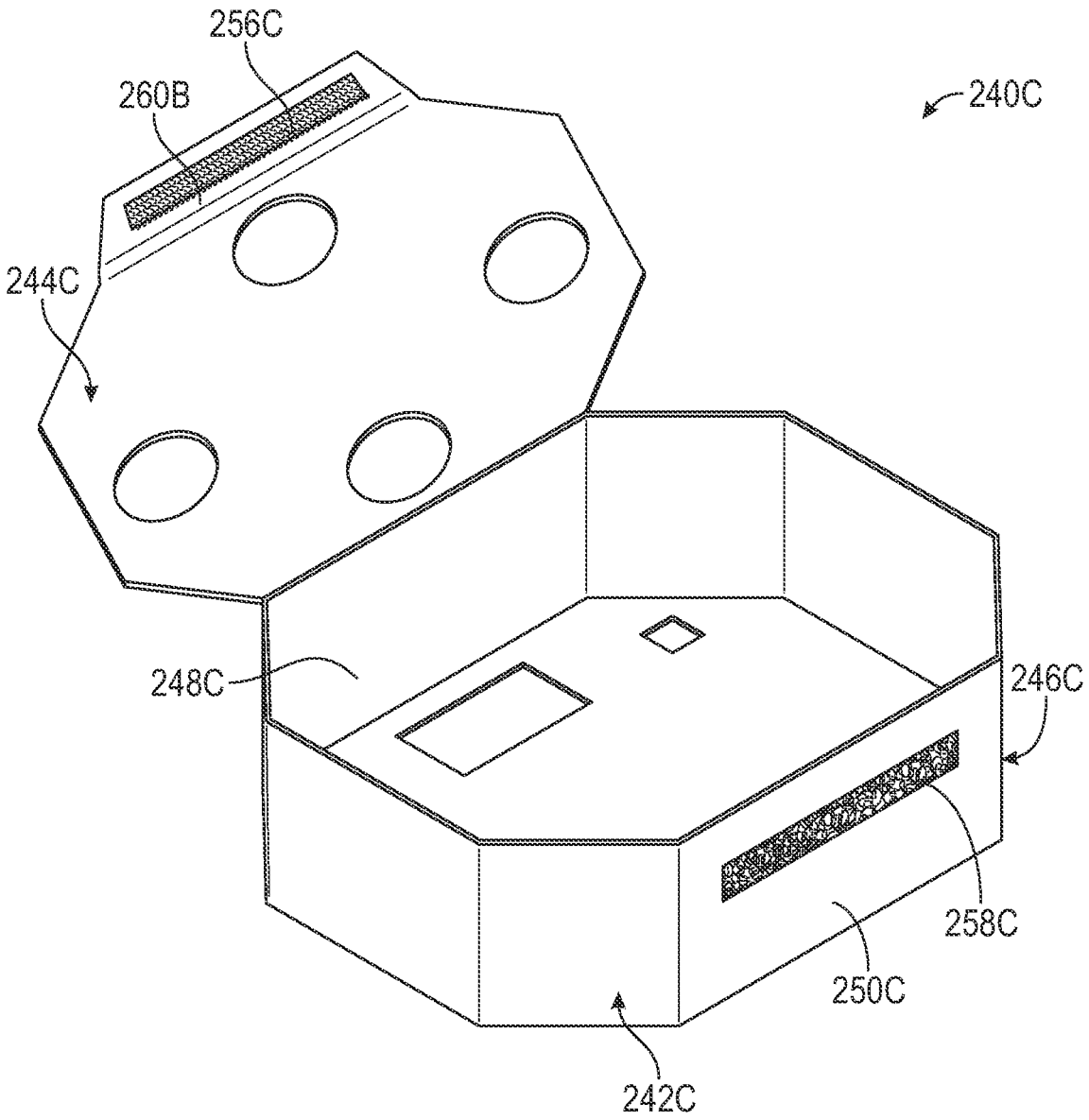

Although a button 158 and a buttonhole 156 are discussed as a means to secure the top flap 144 to the skirt 146, in other embodiments, such as discussed in relation to FIGS. 2A-2C, other means may be used to removably attach the top flap 144 to the skirt 146.

In some embodiments, the casing 140 is configured to stretch when disposed on the robot 100. In some embodiments, the deformable body 142 and the top flap 144 comprise a woven or knit cloth or fabric. In some embodiments, the deformable body 142 and the top flap 144 comprise elastic fibers such as spandex. In some embodiments, the support member openings 152 of the top flap 144 may not comprise the slits 154, and instead the top flap 144 may be stretched such that the support member openings 152 fit over the support members 102 when the top flap 144 is removably attached to the second portion 150 of the skirt 146.

In some embodiments, the plate 104 supports a removable platen (not shown) and the removable platen carries the garment 106. For example, the removable platen may be used to transfer the garment 106 between different direct to garment digital processing stages.

In some embodiments, the support members 102 may be referred to as columns or prongs.

Figure 1C:
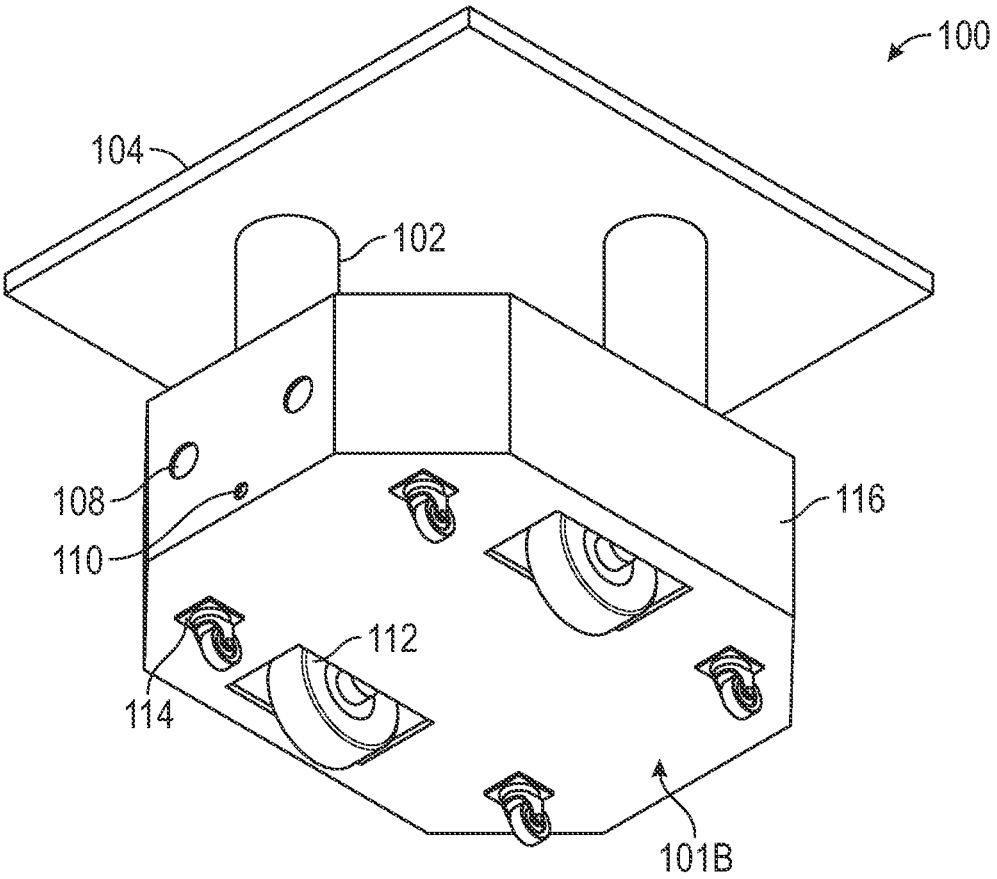
FIGS. 1C and 1D depict bottom isometric views of the wheeled robot and the cover from FIGS. 1A and 1B, according to some embodiments.
Figure 1D:
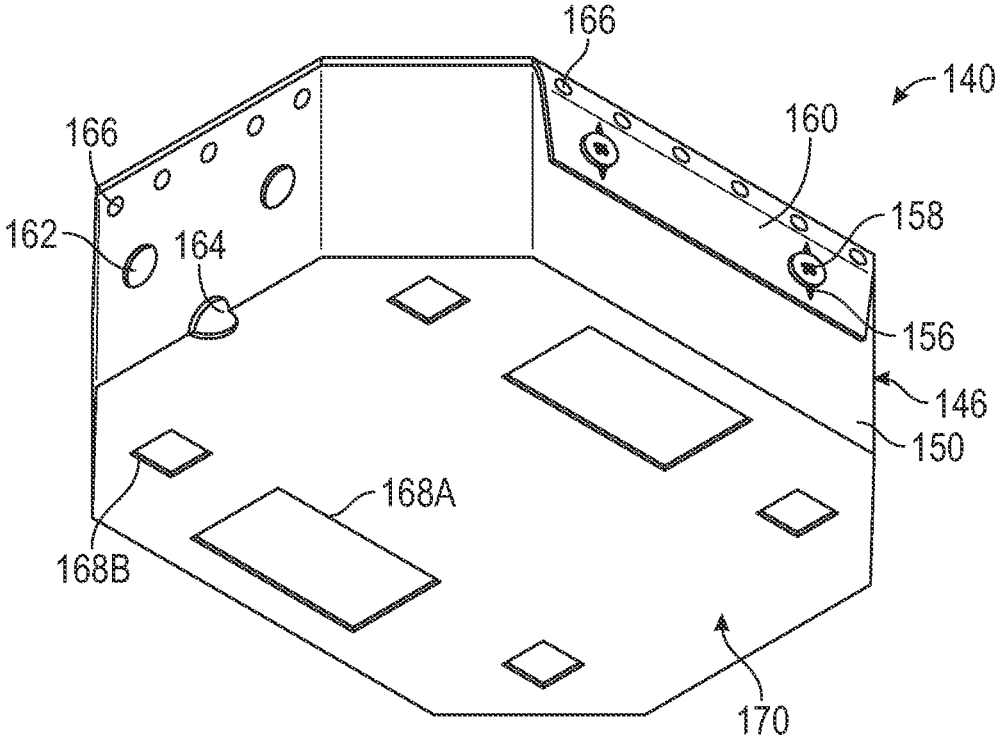

FIGS. 1C and 1D depict bottom isometric views of the wheeled robot 100 and the casing 140 from FIGS. 1A and 1B, according to some embodiments. In particular, FIG. 1C shows the at least one motorized wheel 112 and the caster wheels 114, which are attached to or protrude through a bottom 101B of the robot 100. The deformable body 142 of the casing 140 may comprise a bottom 170 as depicted in FIG. 1D. The bottom 170 may conform to the bottom 101B of the robot 100. A plurality of wheel openings 168 may be formed in the bottom 170 of the casing 140. In the depicted embodiment, the deformable body 142 comprises the bottom 170 and the skirt 146. The bottom 170 may be coupled to the skirt 146. The bottom 170 defines the wheel openings 168 (e.g., motorized wheel openings 168A and caster wheel openings 168B), which allow the wheels 112 and 114 of the robot 100 to pass through the deformable body 142. The wheel openings 168 beneficially allow the wheels 112 and 114 of the robot 100 move and rotate while the robot 100 is disposed within the casing 140.

Figure 1E:
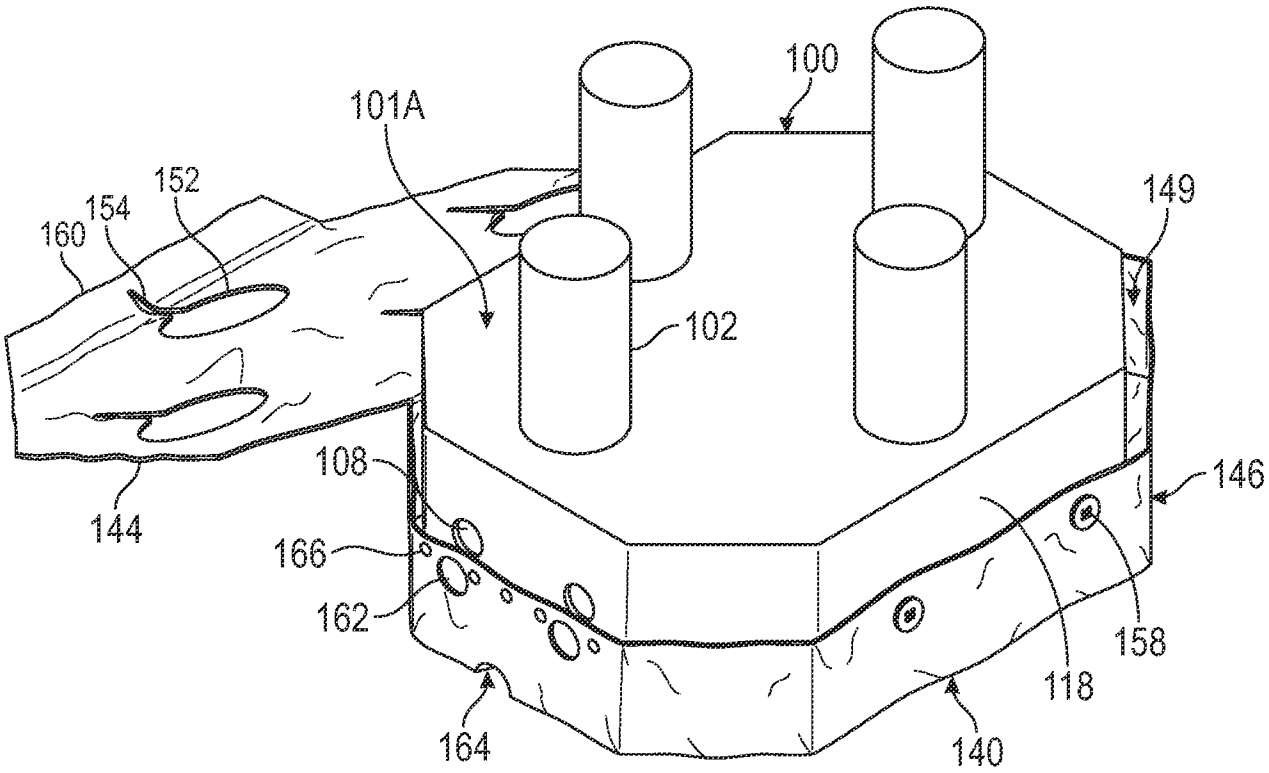
FIGS. 1E and 1F depict a cover during installation on a wheeled robot, according to some embodiments.
Figure 1F:
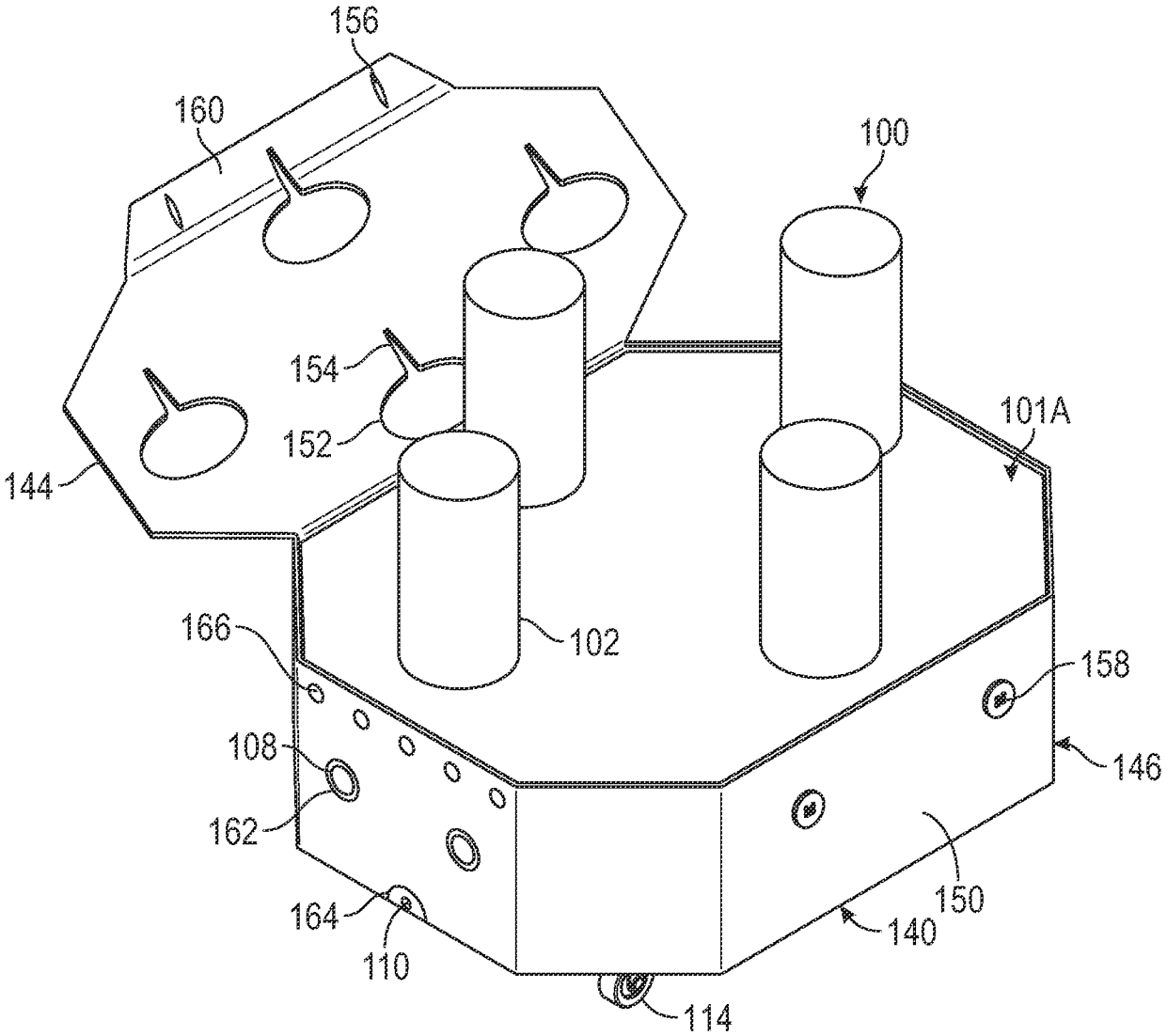

FIGS. 1E and 1F depict the casing 140 disposed on the robot 100, such as during installation or removal, according to some embodiments. The plate 104 may be removed from the robot 100 to facilitate installation or removal of the casing 140.

In particular, FIG. 1E depicts the casing 140 deformed (e.g., bunched up) during installation or removal on the robot 100. In the depicted embodiment, a portion of the robot 100 is not shown to illustrate the interior surface 149 of the deformable body 142. As previously discussed above, the interior surface 149 of the deformable body 142 engages the exterior side surface 118 of the robot 100 when the robot 100 is disposed within the casing 140.

The embodiment shown in FIG. 1F shows the deformable body 142 of the casing 140 conforming to the robot 100 and the top flap 144 partially closed (or open), exposing the top 101A of the robot 100. As previously discussed above, the top flap 144 may be folded over the top 101A of the robot 100 such that the support members 102 pass through the slits 154 and the support member openings 152 when the top flap is attached to the second portion 150 of the skirt 146.

In some embodiments, the support member openings 152 may be reinforced. For example, the top flap 144 may comprise sewing around the support member openings 152 or use grommets or eyelets with the support member openings 152.

Example of Fastening Systems for Removably Attaching Portions of the Cover

FIGS. 2A-2C depict different fastening systems of casings 240, according to some embodiments. The casings 240 (e.g., a first casing 240A, a second casing 240B, and a third casing 240C) are similar to the casing 140 in FIGS. 1A-1F, except as noted. Each casing 240A-C comprises a top flap 244 (e.g., 244A-C), a deformable body 242 (e.g., 242A-C), and a skirt 246 (e.g., 246A-C) having a first portion 248 (e.g., 248A-C) and a second portion 250 (e.g., 250A-C).

The embodiment depicted in FIG. 2A shows the first casing 240A comprises a zipper to removably attach the top flap 244A to at least the second portion 250A of the skirt 246A. The zipper includes a first zipper half 256A attached to the top flap 244A, a second zipper half 258A attached to the skirt 146, and a slider 257 to zip the zipper halves 256A and 258A together.

The embodiment depicted in FIG. 2B shows the second casing 240B comprises a snap faster to removably attach the top flap 244B to at least the second portion 250B of the skirt 246B. The snap fastener includes a socket 256B attached to a fastening portion 260A of the top flap 244B that operationally engages a stud 258B, which is attached to the second portion 250B.

The embodiment depicted in FIG. 2C shows the third casing 240C comprises a hook and loop fastener to removably attach the top flap 244C to at least the second portion 250C of the skirt 246C. The hook and loop fastener includes a hook tape 256C attached to a fastening portion 260B of the top flap 244C that operationally engages a loop tape 258C, which is attached to the second portion 250C.

In some embodiments, the components of the snap fastener or the hook and loop fastener may be reversed. For example, the socket 256B may attach to the top flap 244B and the stud 258B may attach to the fastening portion 260A. The hook tape 256C may attach to the top flap 244B and the loop tape 258C may attach to the fastening portion 260A. In some embodiments, different fastening systems may be used. For example, magnets (e.g., permanent magnets, temporary magnets, and electromagnets), elastic bands, clasps, laces, hooks, and the like may be used to removably couple the top flap 244 to the deformable body 242. In some embodiments, the fastening system comprises electromagnetic magnets that may be controlled by the computer 199.

Figure 2D:
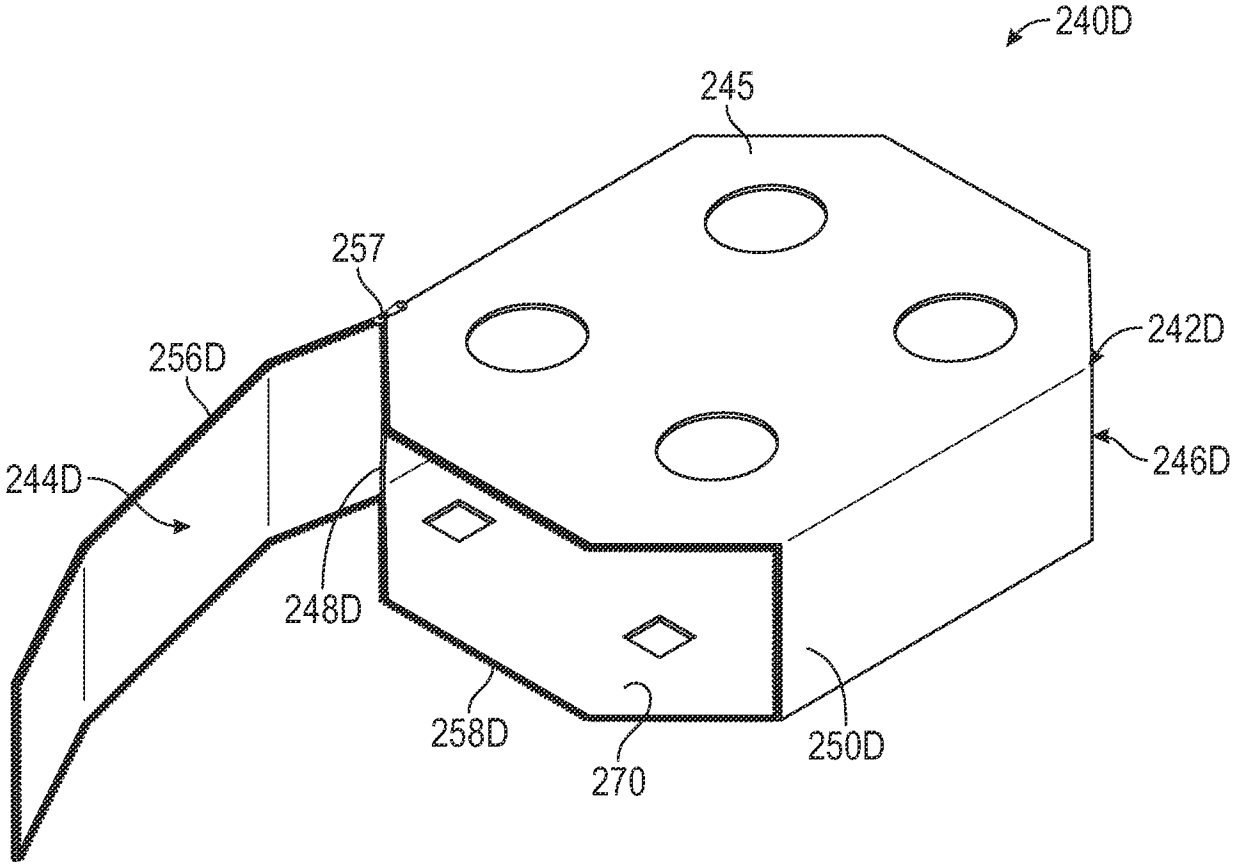
FIG. 2D depicts a cover having a side flap, according to some embodiments.

FIG. 2D depicts a fourth casing 240D having a side flap 244D, according to some embodiments. The fourth casing 240D is similar to the first casing 240A, except as noted.

The fourth casing 240D comprises a deformable body 242D. In the depicted embodiment, the deformable body 242D includes a top 245, a bottom 270, and a skirt 246D having a first portion 248D and a second portion 250D. The side flap 244D is coupled to the first portion 248D. A zipper removably attaches the side flap 244D to at least the second portion 250D of the skirt 246D. In the depicted embodiment, the zipper attaches the side flap 244D to the top 245, the bottom 270, and the second portion 250D. The zipper includes a first zipper half 256D attached to the side flap 244D, a second zipper half 258D attached to the deformable body 242D, and the slider 257 to zip the zipper halves 256D and 258D together.

Examples of Bumpers for Protecting the Cover and the Wheeled Robot

Figure 3A:
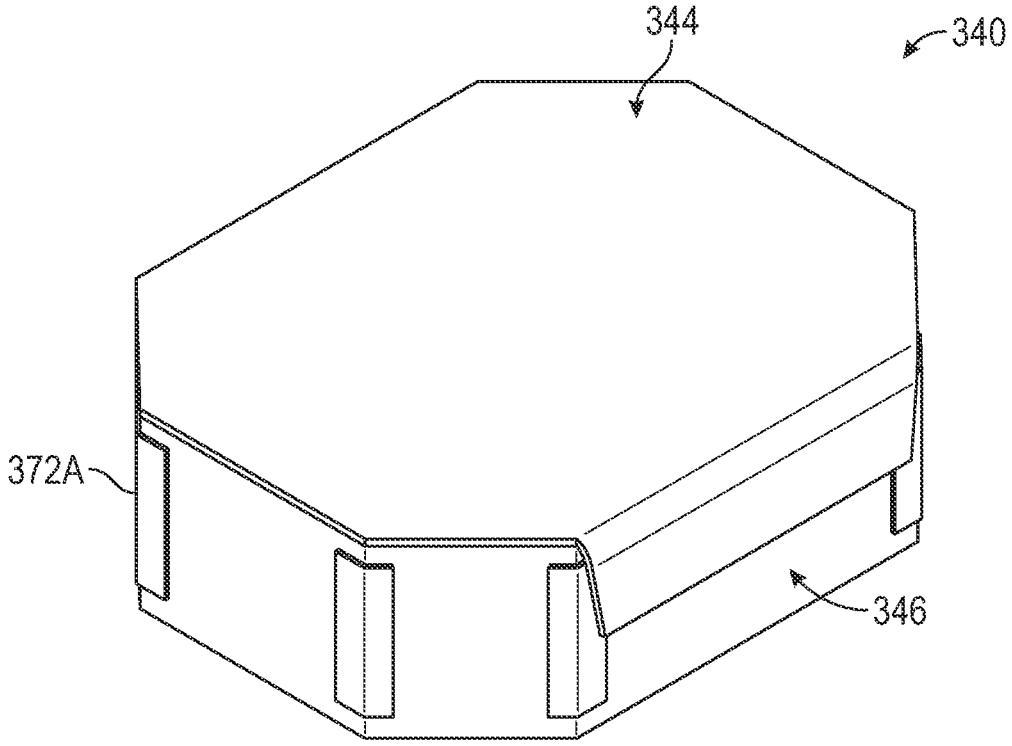
FIGS. 3A and 3B depict different bumpers on a cover, according to some embodiments.
Figure 3B:
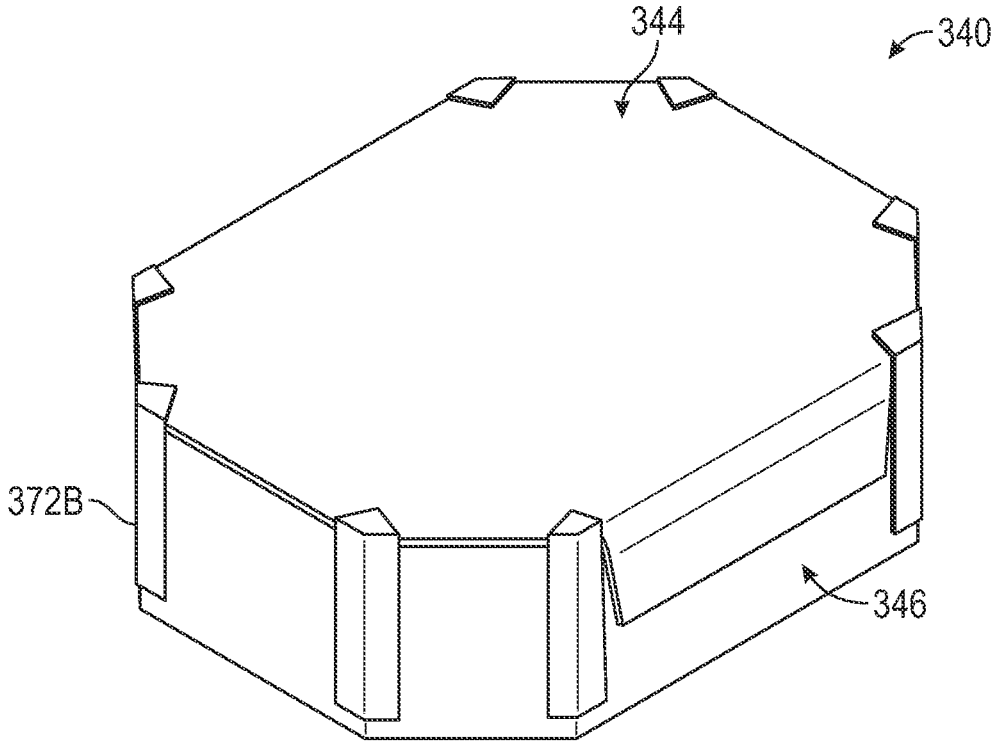

FIGS. 3A and 3B depict different bumpers 372 (e.g., a first plurality of bumpers 372A and a second plurality of bumpers 372B) on a casing 340, according to some embodiments. The casing 340 may be similar to the casing 140 discussed in relation to FIGS. 1A-1D, except as noted. For example, the casing 340 may have a top flap 344 and a skirt 346.

In the embodiment depicted in FIG. 3A, the casing 340 comprises the first plurality of bumpers 372A, which attach to the skirt 346. The first plurality of bumpers 372A may protect the robot 100 (FIG. 1A) from impact and wear. In some embodiments, the first plurality of bumpers 372A may be integrally formed in the skirt 346. In the embodiment depicted in FIG. 3B, the top flap 344 of the casing 340 comprises the second plurality of bumpers 372B. The second plurality of bumpers 372B may be otherwise similar to the first plurality of bumpers 372A.

In some embodiments, the bumpers 372 may be a flexible pad. In some embodiments, the flexible pad may be made of foam or elastomer. In some embodiments, the bumpers 372 may be the same material as the skirt 346 and/or the top flap 344. In some embodiments, the bumpers 372 may be removable such that they may be replaced if damaged. In some embodiments, the bumpers 372 may offer a sacrificial wear surface, beneficially increasing the life of the casing 340.

Example Programmable Display for the Cover

Figure 4:
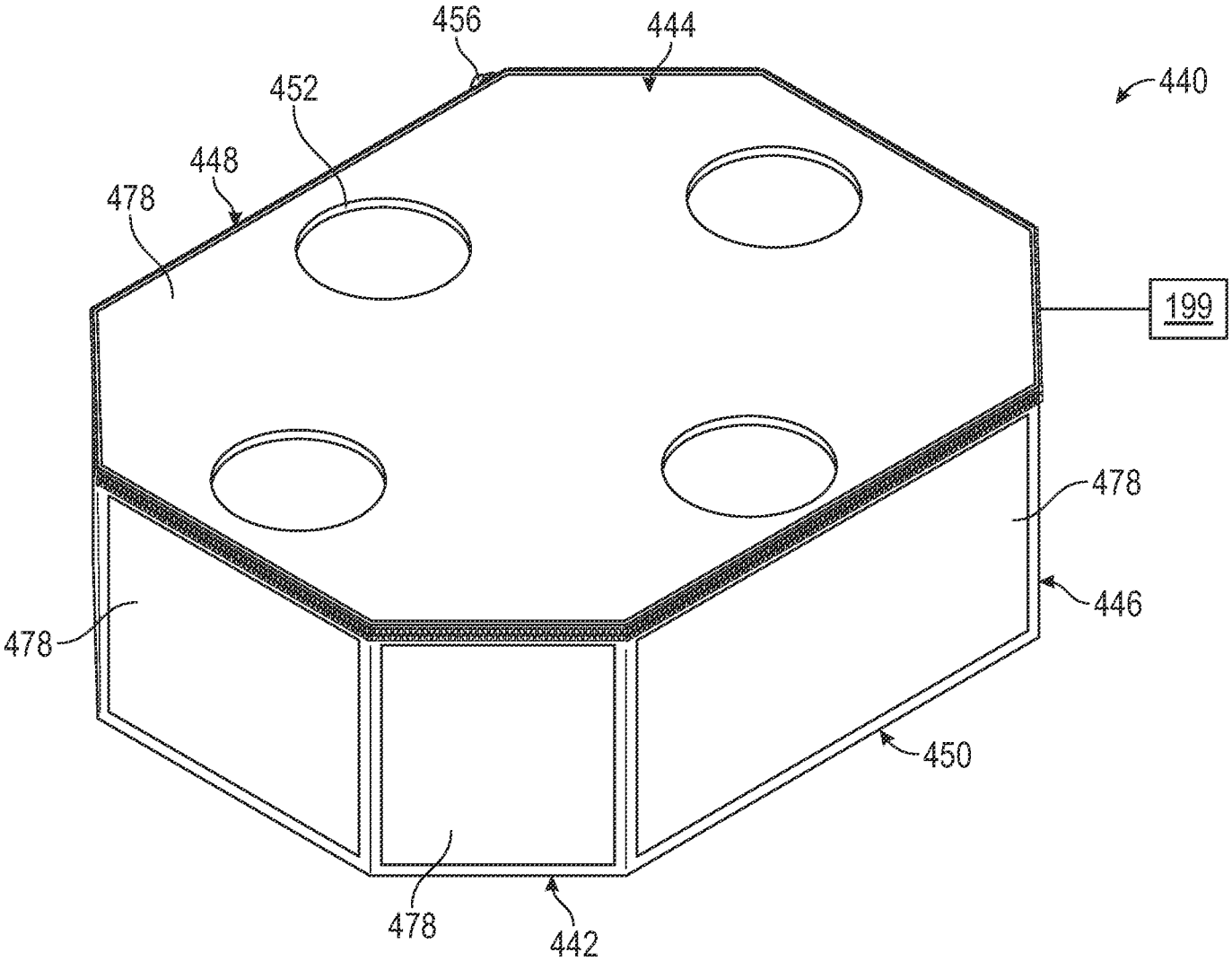
FIG. 4 depicts a cover having a programmable display, according to some embodiments.

FIG. 4 depicts a casing 440 having a programmable display 478, according to some embodiments. The casing 440 is similar to the first casing 240A in FIG. 2A, except as noted. A zipper 456 may secure a top flap 444 to a skirt 446 of a deformable body 442. For example, the zipper 456 couples the top flap 444 to a first portion 448 and a second portion 450 of the skirt 446.

The casing 440 comprises a plurality of programmable displays 478 that may be programmed to display various items or graphics. The programmable displays may be integrally formed in the casing 440 or attach to the casing 440. The computer 199 may control content displayed on the programmable displays 478. In some embodiments, the programmable displays 478 may be used to identify a robot 100 (FIG. 1E) disposed inside the casing 440 or to communicate with surrounding robots or people, similar to the lights 166 described in relation to FIG. 1B. In some embodiments, the programmable displays 478 may display a logo, a pattern, or some form of branding to associate the casing 440 (and thus the robot 100) with a company as desired. In some embodiments, the computer 199 may change what is displayed on the programmable displays 478 based on what the robot 100 is transporting. For example, if the robot 100 is transporting a garment (e.g., the garment 106) from Brand "X," than the programmable displays 478 may display visuals associated with Brand "X". In the depicted embodiments, the programmable displays 478 may be flexible to deform with the deformable body 442. In some embodiments, the programmable displays 478 may comprise an organic liquid crystal display (OLCD), organic light emitting diode (OLED), amorphous silicon (aSi) liquid crystal display (LCD), low-temperature polycrystalline silicon (LTPS) LCD, or indium gallium zinc oxide (IGZO) LCD. In some embodiments, the programmable displays 478 may be powered by a battery pack (not shown) of the casing 440. In some embodiments, the programmable displays 478 may be powered by the robot 100 (FIG. 1E). In some embodiments, the casing 440 may only have one programmable display 478.

The top flap 444 defines a plurality of support member openings 452 sized and shaped to receive a respective support member 102 of the robot 100. The zipper 456 allows the top flap to be decoupled from the deformable body 442, which beneficially prevents stretching or deforming the programmable displays 478 when the support member openings 452 receive the support members 102 and the top flap 444 is coupled to the deformable body 442.

In some embodiments, the casing 440 may include a means of attaching one or more decorative panels to various surfaces of the casing 440 instead of, or in combination with programmable displays 478. For example, as shown in FIG. 4, any one or more of the programmable displays 478 may be a decorative panel. In some embodiments, the decorative panels may attach to the casing 440 through the fastening systems previously discussed in relation to FIGS. 1 and 2. For example, the decorative panels may attach to the casing 440 surfaces by mechanical, or magnetic force, including magnets, hooks, adhesive, zippers, etc. In some embodiments, the decorative panels form a removable outer skin of the casing 440. In some embodiments, the removable outer skin may be used for quick replacement of the decorative panels, similar to the bumpers 372 discussed in relation to FIGS. 3A and 3B. In some embodiments, the decorative panels may be used to display logos, artwork, or brands of a particular company or customer. Thus, the casing 440 may also provide easy, quick re-skinning of the robots with decorative features. In some embodiments, the decorative panels may be rigid, but also may be flexible in other embodiments.

Example Cover for Use with a Circular Wheeled Robot

Figure 5:
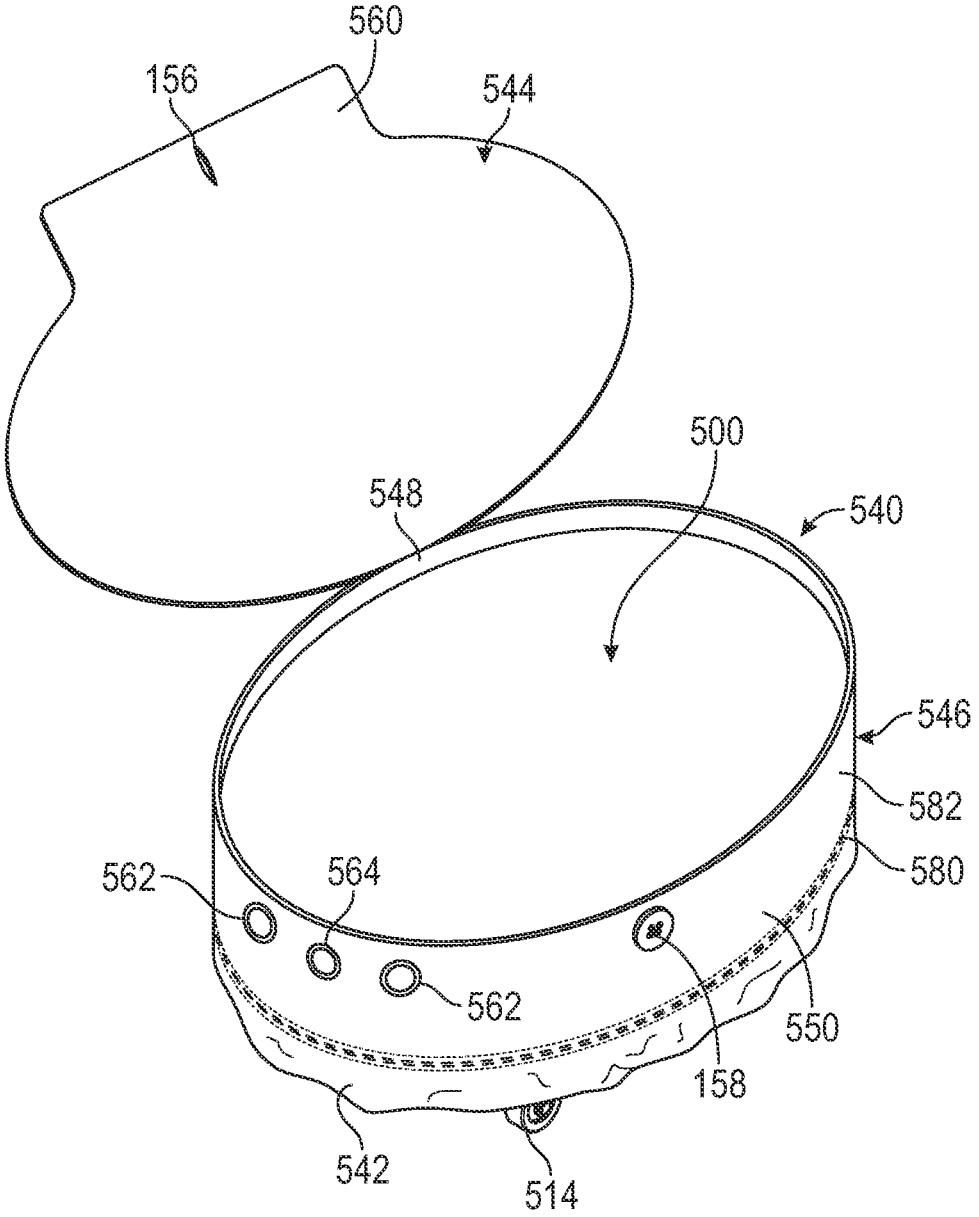
FIG. 5 depicts a cover installed on a wheeled robot, according to some embodiments.

FIG. 5 depicts a casing 540 installed on a robot 500, according to some embodiments. In the depicted embodiment, the robot 500 has a circular shape and wheels, such as a plurality of caster wheels 514 (one of which is shown). The robot 500 may also have a sensor and lights (shown but not labeled) similar to the robot 100 in FIG. 1A.

The casing 540 comprises a top flap 544 coupled to a first portion 548 of a skirt 546 of a deformable body 542. The top flap 544 may removably attach to a second portion 550 of the skirt 546, for example, through a fastening portion 560, to allow access to the robot 500. In the depicted embodiment, the skirt 546 is open at the bottom and does not have a bottom as discussed in relation to FIG. 1D (e.g., the bottom 170). The wheels of the robot 500 may pass through the opening formed by the skirt 546. An elastic band 580 may be coupled to the skirt 546 and removably attach the casing 540 to the robot 500. For example, the elastic band 580 may be sewn in the skirt 546 using stitching 582. The skirt 546 may further define light openings 562 for the robot's 500 lights and a sensor opening 564 for the robot's 500 sensor.

In some embodiments, the casing 540 may use a means other than the elastic band 580 to removably attach to the robot 500. For example, the casing 540 may be removably attached to the robot 500 using the snap fasteners or hook and loop fasteners described in relation to FIGS. 2B and 2C. In some embodiments, the casing 540 may be removably attached to the robot 500 using cord and toggle locks.

The casings 140, 240, 340, 440, and 540 previously discussed in relation to FIGS. 1-5 could comprise any combination of the components previously discussed in different embodiments. For example, the casings 140, 240, 340, 440, and 540 may comprise any combination of the support member openings 152 and optional slits 154, wheel openings 168, light openings 162, sensor openings 164, lights 166, bumpers 372, elastic band 580, and programmable displays 478. The casings 140, 240, 340, 440, and 540 may further be secured using different fastening systems such as buttonholes 156 and buttons 158, zippers (e.g., 256A, 257, and 258A or 456), snap fasteners (e.g., 256B and 258B), and hook and loop fasteners (e.g., 256C and 258C).

In some embodiments, the casings 140, 240, 340, 440, and 540 are configured to be reusable.

In some embodiments, the casings 140, 240, 340, 440, and 540 may be referred to as a removable skin. In some embodiments, the removable skin may refer to the deformable body (e.g., 142, 242, and 442) and/or the skirt (e.g., 146, 246, 346, 446, and 546).

Although the casings 140, 240, 340, 440, and 540 are described as having a top flap (e.g., the top flaps 144, 244, 344, 444, 544 described in relation to FIGS. 1-5) or side flap (e.g., the side flap 244D described in relation to FIG. 2D), in some embodiments, the casings may have a bottom flap. The bottom flap may couple to a deformable body (e.g., the deformable body 142, 242, 442, and 542 described in relation to FIGS. 1, 2, 4, and 5) using any of the fastening systems previously discussed in relation to FIGS. 1 and 2. In some embodiments, the bottom flap may form openings (e.g., the wheel openings 168 described in relation to FIG. 1D) similar to the openings of the top flap (e.g., the support member openings 152 described in relation to FIG. 1B). For example, the openings of the bottom flap may comprise a slit (e.g., the slit 154 described in relation to FIG. 1B) to facilitate installation on a robot.

In some embodiments, any of the casings 140, 240, 340, 440, and 540 may be composed of multiple parts, panels, or segments that are attached or fastened together to form one complete casing to partially or fully encase the robot 100 or 500.

In some embodiments, the casings 140, 240, 340, 440, and 540 of any part of the casings (e.g., the top flap 144, the skirt 146, or the bottom 170 as described in relation to FIGS. 1B and 1D) may comprise a transparent material, a light reflective material, a heat reflective material, a glow-in-the-dark material, a fluorescent material, or any compensation of the materials previously discussed.

Although the casings 140, 240, 340, 440, and 540 are described in relation to wheeled robots (e.g., the wheeled robots 100 and 500 discussed in relation to FIGS. 1 and 5), in some embodiments, the casings may be used with non-wheeled robots. For example, the non-wheeled robots may move using any one or more of tracks or treads, a track or conveyer system, or an electromagnetic propulsion system (e.g., a magnetic levitation system) and the like. In some embodiments, the non-wheeled robots include robotic arms or gantry systems. In some embodiments, the non-wheeled robots are stationary and fixed in one location.

Example Method for Installing a Cover on a Wheeled Robot

Figure 6:
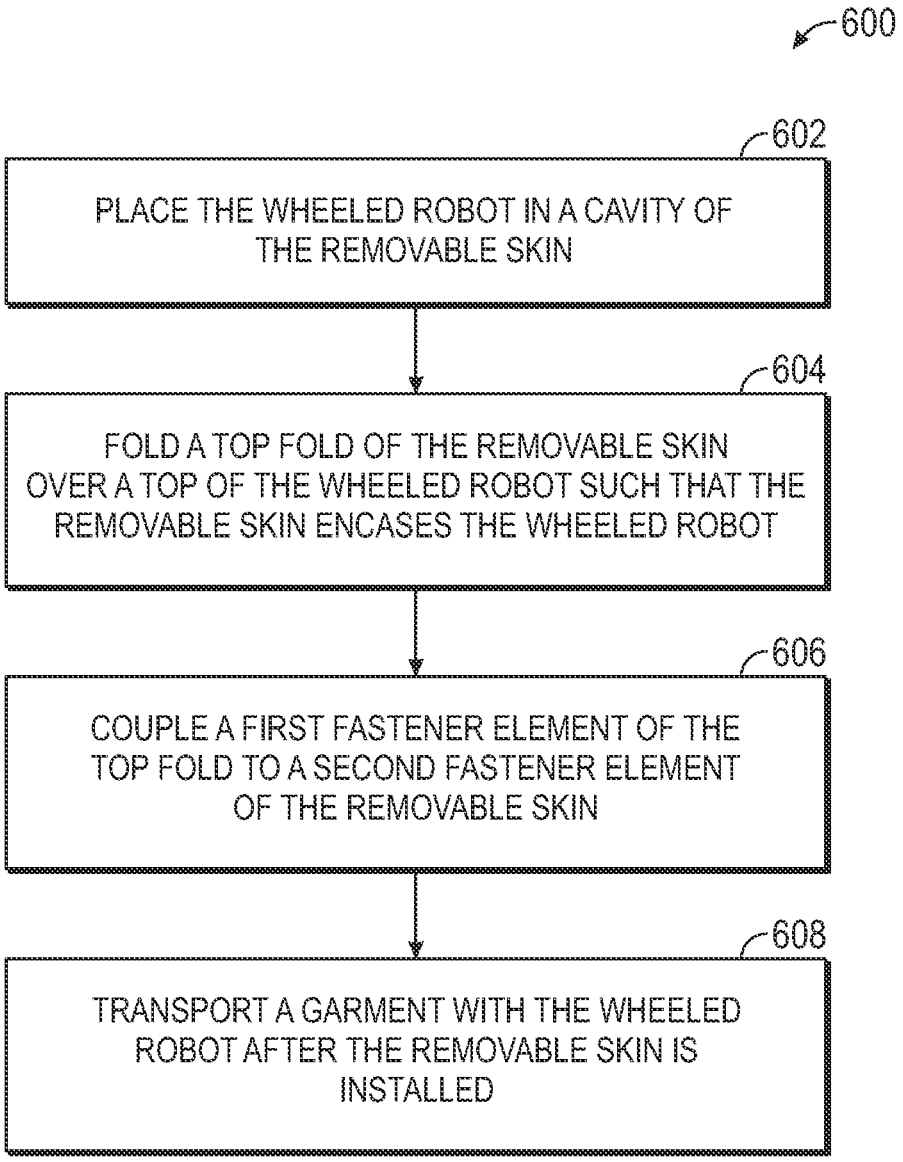
FIG. 6 is a flowchart of a method for installing a removable skin on a wheeled robot, according to some embodiments.

FIG. 6 is a flowchart of a method 600 for installing a removable skin on a wheeled robot, according to one embodiment. In some embodiments, the removable skin be a casing as previously discussed in relation to FIGS. 1-5. The method 600 begins at block 602, where a user places the wheeled robot in a cavity formed by the removable skin as discussed in relation to FIGS. 1 and 5.

At block 604, the user folds a top fold of the removable skin over a top of the wheeled robot such that the removable skin encases the wheeled robot, as discussed in relation to FIGS. 1, 4, and 5.

At block 606, the user couples a first fastener element of the top fold to a second fastener element of the removable skin as discussed in relation to FIGS. 1 and 5.

At block 608, the wheeled robot transports a garment after the removable skin is installed as discussed in relation to FIG. 1A.

In some embodiments of method 600, a wheel of the wheeled robot protrudes through an opening of the removable skin as discussed in relation to FIGS. 1 and 5.

In some embodiments, the removable skin comprises a woven or knit cloth or fabric as discussed in relation to FIG. 1B.

Some embodiments further include the removable skin blinking a plurality of lights at a predefined frequency or pattern as discussed in relation to FIG. 1B.

Some embodiments further include the removable skin displaying an image or pattern on a programmable display as discussed in relation to FIG. 4.

Example Controller for Cover

FIG. 7 depicts a functional block diagram of one example of a computer 199 of FIGS. 1B and 4, according to some embodiments. The computer 199 includes a processor 710 in data communication with a memory 720, an input device 730, and an output device 740. Though not shown, other computers such as a computer of the robot 100 (FIG. 1) may have similar components as shown for computer 199. Although described separately, it is to be appreciated that functional blocks described with respect to the computer 199 need not be separate structural elements. For example, the processor 710 and memory 720 may be embodied in a single chip. In some embodiments, the computer 199 may be referred to as a controller or system controller.

The processor 710 can be a general purpose processor, a digital signal processor ("DSP"), an application specific integrated circuit ("ASIC"), a field programmable gate array ("FPGA") or other programmable logic device, discrete gate or transistor logic, discrete hardware components, or any suitable combination thereof designed to perform the functions described herein. A processor may also be implemented as a combination of computing devices, e.g., a combination of a DSP and a microprocessor, a plurality of microprocessors, one or more microprocessors in conjunction with a DSP core, or any other such configuration.

The processor 710 can be coupled, via one or more buses, to read information from or write information to memory 720. The processor may additionally, or in the alternative, contain memory, such as processor registers. The memory 720 can include processor cache, including a multi-level hierarchical cache in which different levels have different capacities and access speeds. The memory 720 can also include random access memory (RAM), other volatile storage devices, or non-volatile storage devices. The storage can include hard drives, flash memory, etc. In various instances, the memory 720 may be referred to as a computer-readable storage medium. The computer-readable storage medium is a non-transitory device capable of storing information, and is distinguishable from computer-readable transmission media such as electronic transitory signals capable of carrying information from one location to another. Computer-readable medium as described herein may generally refer to a computer-readable storage medium or computer-readable transmission medium.

The processor 710 also may be coupled to an input device 730 and an output device 740 for, respectively, receiving input from and providing output to a user of the computer 199. The input device 730 may include the robot 100 or 500 discussed in relation to FIGS. 1 and 5. Other suitable input devices 730 include, but are not limited to, a keyboard, buttons, keys, switches, a pointing device, a mouse, a joystick, a remote control, an infrared detector, or a microphone (possibly coupled to audio processing software to, e.g., detect voice commands). The output device 740 may include the lights 166 and the programmable displays 478 discussed in relation to FIGS. 1 and 5. Other suitable output devices 740 include, but are not limited to, visual output devices, including displays and printers, audio output devices, including speakers, headphones, earphones, and alarms, electromagnetic fasteners, and haptic output devices.

In the current disclosure, reference is made to various embodiments. However, it should be understood that the present disclosure is not limited to specific described embodiments. Instead, any combination of the following features and elements, whether related to different embodiments or not, is contemplated to implement and practice the teachings provided herein. Additionally, when elements of the embodiments are described in the form of "at least one of A and B," it will be understood that embodiments including element A exclusively, including element B exclusively, and including element A and B are each contemplated. Furthermore, although some embodiments may achieve advantages over other possible solutions or over the prior art, whether or not a particular advantage is achieved by a given embodiment is not limiting of the present disclosure. Thus, the aspects, features, embodiments and advantages disclosed herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

As will be appreciated by one skilled in the art, embodiments described herein may be embodied as a system, method or computer program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments described herein may take the form of a computer program product embodied in one or more computer readable medium(s) having computer readable program code embodied thereon.

Program code embodied on a computer readable medium may be transmitted using any appropriate medium, including but not limited to wireless, wireline, optical fiber cable, RF, etc., or any suitable combination of the foregoing.

Computer program code for carrying out operations for embodiments of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described herein with reference to flowchart illustrations or block diagrams of methods, apparatuses (systems), and computer program products according to embodiments of the present disclosure. It will be understood that each block of the flowchart illustrations or block diagrams, and combinations of blocks in the flowchart illustrations or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the block(s) of the flowchart illustrations or block diagrams.

These computer program instructions may also be stored in a computer readable medium that can direct a computer, other programmable data processing apparatus, or other device to function in a particular manner, such that the instructions stored in the computer readable medium produce an article of manufacture including instructions which implement the function/act specified in the block(s) of the flowchart illustrations or block diagrams.

The computer program instructions may also be loaded onto a computer, other programmable data processing apparatus, or other device to cause a series of operational steps to be performed on the computer, other programmable apparatus or other device to produce a computer implemented process such that the instructions which execute on the computer, other programmable data processing apparatus, or other device provide processes for implementing the functions/acts specified in the block(s) of the flowchart illustrations or block diagrams.

The flowchart illustrations and block diagrams in the Figures illustrate the architecture, functionality, and operation of possible implementations of systems, methods, and computer program products according to various embodiments of the present disclosure. In this regard, each block in the flowchart illustrations or block diagrams may represent a module, segment, or portion of code, which comprises one or more executable instructions for implementing the specified logical function(s). It should also be noted that, in some alternative implementations, the functions noted in the block may occur out of the order noted in the Figures. For example, two blocks shown in succession may, in fact, be executed substantially concurrently, or the blocks may sometimes be executed in the reverse order or out of order, depending upon the functionality involved. It will also be noted that each block of the block diagrams or flowchart illustrations, and combinations of blocks in the block diagrams or flowchart illustrations, can be implemented by special purpose hardware-based systems that perform the specified functions or acts, or combinations of special purpose hardware and computer instructions.

While the foregoing is directed to embodiments of the present disclosure, other and further embodiments of the disclosure may be devised without departing from the basic scope thereof, and the scope thereof is determined by the claims that follow.

What is claimed is:

1. A cover for use with a wheeled robot, comprising:

a deformable body substantially sized and shaped to receive the wheeled robot and conform thereto, the deformable body comprising a skirt defining an interior surface to engage with a corresponding exterior side surface of the wheeled robot; and a top flap coupled to the deformable body, wherein the top flap is coupled to a first portion of the skirt and the top flap is configured to removably attach to at least a second portion of the skirt to allow access to the wheeled robot, wherein the top flap further defines a plurality of support member openings, wherein:

each support member opening is sized and shaped to receive a respective support member of the wheeled robot, the respective support member is configured to support a platen, and a slit for at least one support member opening of the plurality of support member openings, the slit configured to allow the at least one support member opening to expand to compensate for a height of the respective support member, and wherein the cover is configured to removably conform to the wheeled robot.

2. The cover of claim 1, wherein the deformable body defines at least one light opening configured to allow light from a light of the wheeled robot to pass through.

3. The cover of claim 1, wherein the deformable body defines a sensor opening configured to allow a sensor of the wheeled robot to sense through the cover.

4. The cover of claim 1, further comprising a programmable display.

5. The cover of claim 1, wherein the deformable body and the top flap comprise a woven or knit cloth or fabric.

6. The cover of claim 1, wherein a zipper is configured to removably attach the top flap to at least the second portion of the skirt.

7. The cover of claim 1, wherein a button is configured to removably attach the top flap to at least the second portion of the skirt.

8. The cover of claim 1, wherein a hook and loop fastener is configured to removably attach the top flap to at least the second portion of the skirt.

9. The cover of claim 1, further comprising an elastic band coupled to the skirt, wherein the elastic band is configured to removably conform the cover to the wheeled robot.

10. A cover for use with a wheeled robot, comprising:

a deformable body substantially sized and shaped to receive the wheeled robot and conform thereto, the deformable body comprising a top, a bottom, and a skirt defining an interior surface to engage with a corresponding exterior side surface of the wheeled robot; and a side flap coupled to the deformable body, wherein the side flap is coupled to a first portion of the skirt and the side flap is configured to removably attach to at least a second portion of the skirt to allow access to the wheeled robot, wherein the cover is configured to removably conform to the wheeled robot, and wherein the bottom defines a plurality of wheel openings configured to allow wheels of the wheeled robot to pass through the cover.

11. The cover of claim 10, wherein the cover is configured to removably conform to the wheeled robot via the side flap.

12. The cover of claim 10, further comprising a plurality of lights.

13. The cover of claim 10, further comprising bumpers configured to protect the wheeled robot.

14. A method of installing a removable skin on a wheeled robot, comprising:

placing the wheeled robot in a cavity formed by the removable skin, wherein a wheel of the wheeled robot protrudes through an opening of the removable skin;

folding a top fold of the removable skin over a top of the wheeled robot such that the removable skin encases the wheeled robot; and coupling a first fastener element of the top fold to a second fastener element of the removable skin.

15. The method of claim 14, wherein a support member of the wheeled robot protrudes through a support member opening of the top fold.

16. The method of claim 15, further comprising placing a plate on the support member of the wheeled robot after the removable skin is installed.

17. The method of claim 14, further comprising moving the wheeled robot after the removable skin is installed.

18. A cover for use with a wheeled robot, comprising:

a deformable body substantially sized and shaped to receive the wheeled robot and conform thereto, the deformable body comprising a skirt defining an interior surface to engage with a corresponding exterior side surface of the wheeled robot;

a top flap coupled to the deformable body, wherein the top flap is coupled to a first portion of the skirt and the top flap is configured to removably attach to at least a second portion of the skirt to allow access to the wheeled robot; and an elastic band coupled to the skirt, wherein the elastic band is configured to removably conform to the wheeled robot.

* * * * *